US008093964B2

(12) United States Patent
Mittelstadt et al.

(10) Patent No.: US 8,093,964 B2
(45) **Date of Patent: *Jan. 10, 2012**

(54) ADD-ON TRIP MODULE FOR MULTI-POLE CIRCUIT BREAKER

(75) Inventors: Chad R. Mittelstadt, Cedar Rapids, IA (US); Cameron Woodson, Cedar Rapids, IA (US)

(73) Assignee: Schneider Electric USA, Inc., Palatine, IL (US)

( * ) Notice: Subject to any disclaimer, the term of this patent is extended or adjusted under 35 U.S.C. 154(b) by 400 days.

This patent is subject to a terminal disclaimer.

(21) Appl. No.: 12/345,313

(22) Filed: Dec. 29, 2008

(65) Prior Publication Data

US 2010/0164657 A1 Jul. 1, 2010

(51) Int. Cl.
*H01H 75/00* (2006.01)
*H01H 77/00* (2006.01)
*H01H 83/00* (2006.01)

(52) U.S. Cl. ..... 335/8; 335/6

(58) Field of Classification Search ..... 335/6, 8
See application file for complete search history.

(56) References Cited

U.S. PATENT DOCUMENTS 3,162,739 A * 12/1964 Klein et al. ..... 335/9
3,264,435 A * 8/1966 Klein et al. ..... 337/48
3,353,128 A * 11/1967 Gauthier ..... 335/35
4,486,803 A 12/1984 Zylstra
4,691,182 A * 9/1987 Mrenna et al. ..... 335/176
4,719,438 A * 1/1988 Mrenna et al. ..... 335/38
4,821,008 A * 4/1989 Micoud et al. ..... 335/189
4,931,757 A * 6/1990 Lemmer et al. ..... 335/131
5,218,331 A * 6/1993 Morris et al. ..... 335/18
5,304,761 A * 4/1994 Rosen et al. ..... 218/157
5,608,367 A * 3/1997 Zoller et al. ..... 335/132
5,670,922 A 9/1997 Montague et al.
6,054,912 A * 4/2000 Kaneko et al. ..... 335/172
6,087,913 A * 7/2000 Castonguay et al. ..... 335/16
6,101,992 A * 8/2000 Pischinger et al. ..... 123/90.11
6,144,271 A * 11/2000 Mueller et al. ..... 335/202
6,175,288 B1 * 1/2001 Castonguay et al. ..... 335/16
6,229,418 B1 * 5/2001 Mueller et al. ..... 335/202
6,239,677 B1 * 5/2001 Ramakrishnan et al. ..... 335/35
6,337,449 B1 1/2002 Brouillat et al.
6,369,340 B1 * 4/2002 Castonguay et al. ..... 200/244
6,788,174 B1 * 9/2004 Afshari et al. ..... 335/42
7,323,956 B1 * 1/2008 Puskar et al. ..... 335/6
2001/0027961 A1 10/2001 Brouillat et al.
2007/0241846 A1 * 10/2007 Puskar et al. ..... 335/6

* cited by examiner

*Primary Examiner* — Lincoln Donovan
*Assistant Examiner* — Alexander Talpalatskiy

(57) ABSTRACT

An add-on module adapted to be attached to the basic mechanical structure of a multi-pole circuit breaker includes multiple extended terminal plates each of which is adapted to replace one of the input and output terminals for one of the poles, multiple electromechanical transducers each of which is coupled to one of the extended terminal plates for producing a mechanical movement in response to a predetermined magnitude of electrical current in the extended terminal plate to which that transducer is coupled, a mechanical actuator coupled to the electromechanical transducers and to the breaker contacts for operating a trip mechanism in response to a predetermined mechanical movement of any of the transducers, and a mechanical reset arm coupling the reset mechanism to the mechanical actuator for resetting the actuator in response to the resetting of the host circuit breaker.

19 Claims, 17 Drawing Sheets

ADD-ON TRIP MODULE FOR MULTI-POLE CIRCUIT BREAKER

FIELD OF THE INVENTION

The present invention relates to add-on modules for multi-pole circuit breakers and, more particularly, to an add-on trip module capable of utilizing the basic mechanical structure of a multiple-pole electronic-trip circuit breaker while replacing the electronic trip actuator with an electromechanical actuator.

BACKGROUND OF THE INVENTION

Multi-pole circuit breakers utilizing electronic actuators for actuating trip mechanisms in response to the detection of various types of fault conditions have become highly developed. The cost of these devices has been controlled in part by mass production of the basic mechanical structure of the breaker (sometimes referred to as the "platform" of the circuit breaker), as well as the electronic portions. These sophisticated circuit breakers, however, are not typically applicable to DC power systems, and available DC electronic trip units are very expensive because traditional current measurement transformers cannot generate their own power in a absence of alternating current, so they must use complex iron cores that move inside a wire bobbin at a set trip current level providing a one-time power generation to fire a solenoid, or an external power supply combined with a Hall effect sensor that can continuously monitor DC current levels.

SUMMARY OF THE INVENTION

In accordance with one embodiment, an add-on module is provided for the basic mechanical structure of a multiple-pole circuit breaker. The basic mechanical structure includes, for each pole:

- a power input terminal and a power output terminal,
- a pair of contacts each of which is connected to a different one of the terminals and at least one of which is movable,
- a trip mechanism coupled to the movable contact for opening the contacts by disengaging the movable contact from the other contact in the pair, and
- a reset mechanism coupled to said trip mechanism for resetting said trip mechanism and said movable contact.

The add-on module is adapted to be attached to the basic mechanical structure and includes:

- multiple extended terminal plates each of which is adapted to replace one of the terminals for one of the poles,
- multiple electromechanical transducers each of which is coupled to one of the extended terminal plates for producing a mechanical movement in response to a predetermined magnitude of electrical current in the extended terminal plate to which that transducer is coupled,
- a mechanical actuator coupled to the electromechanical transducers and to the movable contacts for operating the trip mechanism in response to a predetermined mechanical movement of any of the transducers, and
- a mechanical reset arm coupling the reset mechanism to the mechanical actuator for resetting the actuator in response to the resetting of the host circuit breaker.

In one implementation, the mechanical actuator of the add-on module includes a trip link coupled to the trip mechanism in the host breaker for actuating that trip mechanism to open the contacts; a latch having a latched condition holding the trip link in an untripped position, and an unlatched condition releasing the trip link for movement to a tripped position; and a latch release mechanism for moving the latch to the unlatched condition in response to the predetermined movement of any of the transducers. This implementation preferably includes an energy storage device coupled to the latch and the trip link for moving the trip link to the tripped position in response to the movement of the latch to the unlatched position. The mechanical reset arm may be coupled to the energy storage device for re-charging the energy storage device in response to the resetting of the trip mechanism of the host circuit breaker.

In another implementation, each of the electromechanical transducers includes an element that moves in response to a predetermined magnitude of electrical current in the extended terminal plate to which that transducer is coupled, and a dashpot coupled to the movable element for controlling the rate of movement of the element.

The add-on module permits the electronic sensing and trip-actuating portions of an electronic multi-pole circuit breaker to be easily replaced with an electromechanical sensing and trip-actuating device suitable for use with AC and DC power systems. The basic mechanical structure of the host circuit breaker used with the electronic actuator is used with the add-on module, thus taking advantage of the economics of mass production of that basic mechanical structure. The add-on module itself can be manufactured and assembled at a relatively low cost because it has a small number of parts that are easily assembled.

BRIEF DESCRIPTION OF THE DRAWINGS

The invention may best be understood by reference to the following description taken in conjunction with the accompanying drawings, in which.

DETAILED DESCRIPTION OF THE ILLUSTRATED EMBODIMENTS

Although the invention will be described in connection with certain preferred embodiments, it will be understood that the invention is not limited to those particular embodiments. On the contrary, the invention is intended to cover all alternatives, modifications, and equivalent arrangements as may be included within the spirit and scope of the invention as defined by the appended claims.

Figure 1:
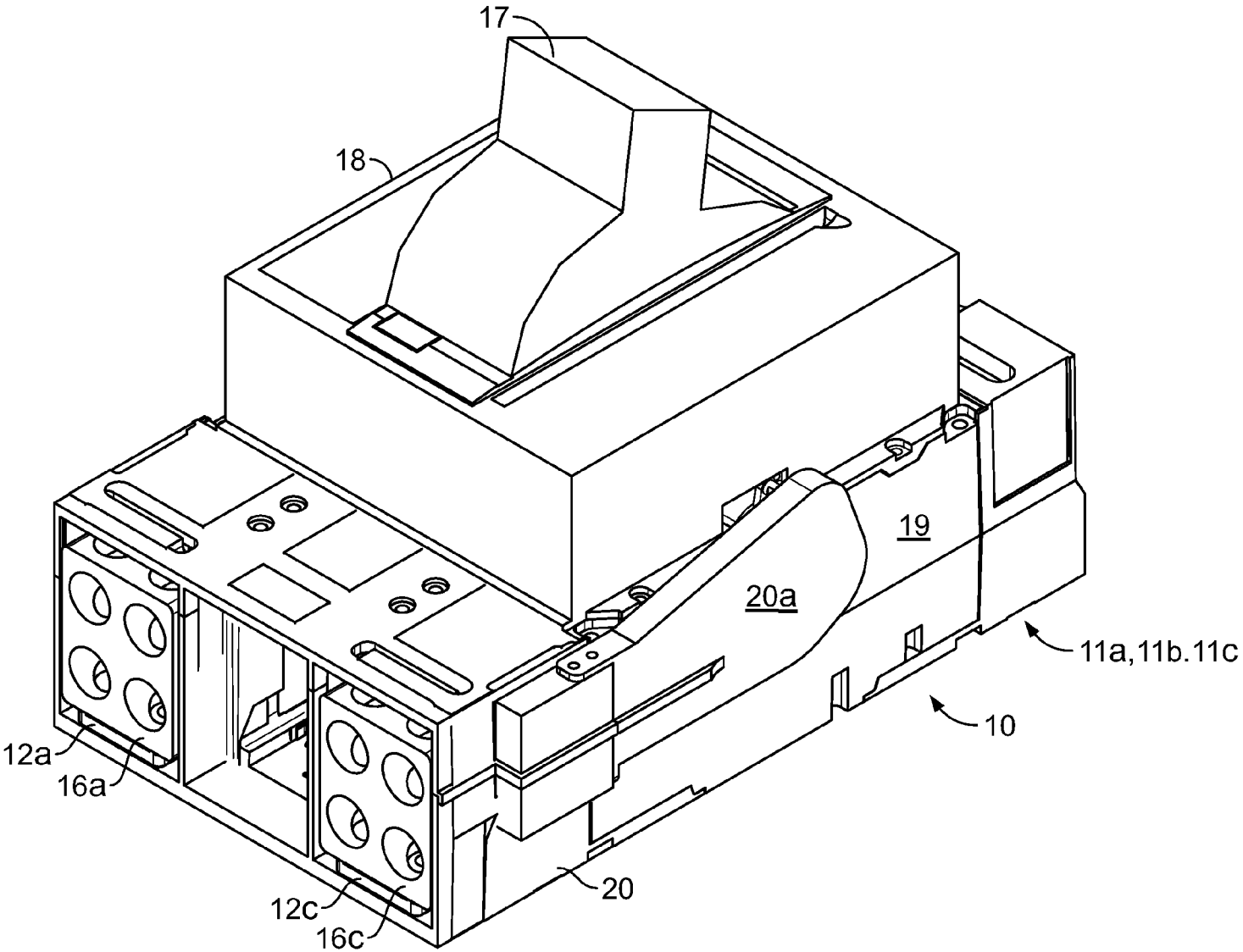
FIG. 1 is a perspective view of a multiple-pole circuit breaker equipped with an add-on module that includes a mechanical actuator for the trip mechanism in the basic mechanical structure of the breaker.
Figure 2:
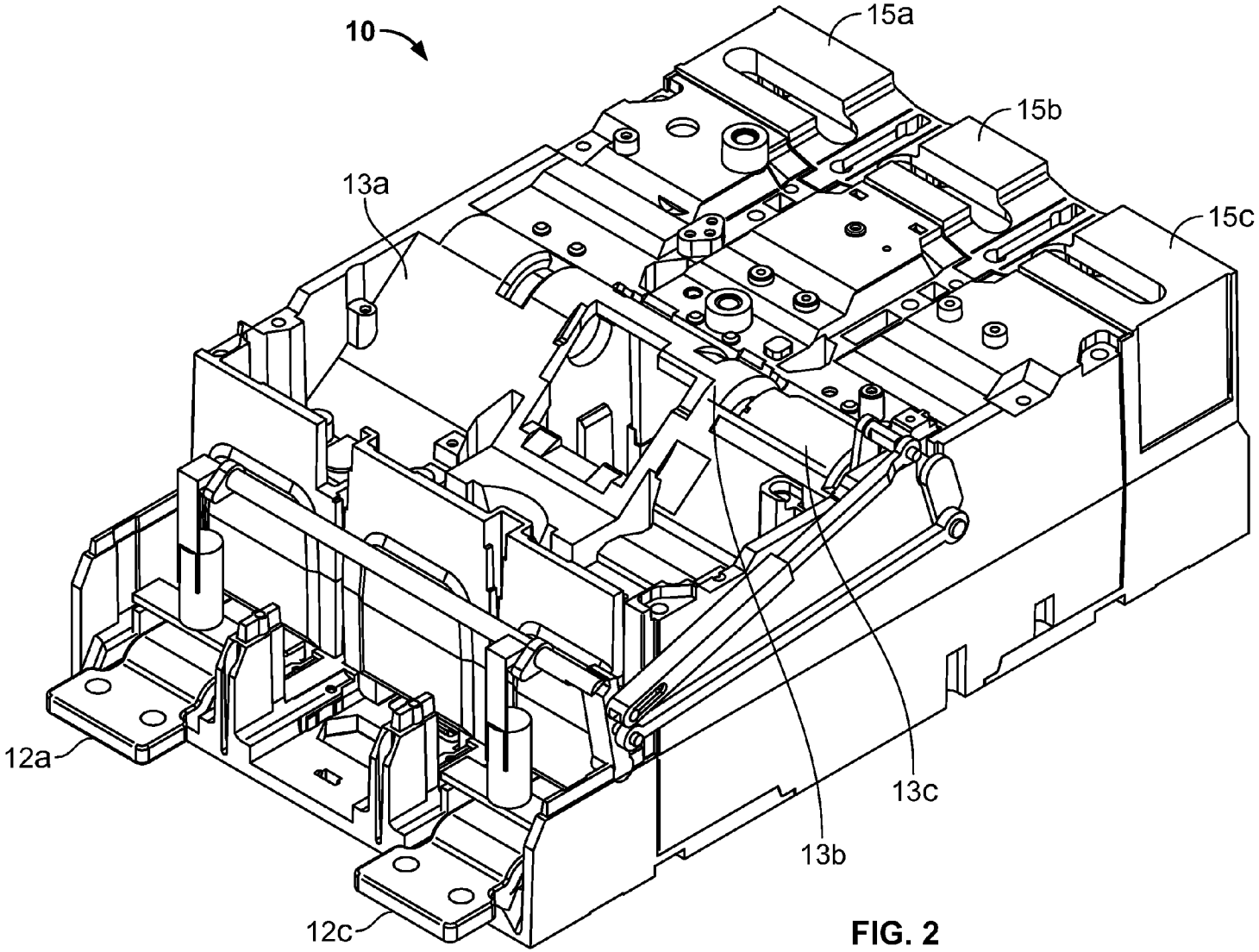
FIG. 2 is the same perspective view as shown in FIG. 1 with the manual toggle and the add-on module housing removed.

Turning now to the drawings, FIGS. 1 and 2 illustrate a three-pole circuit breaker in which the basic mechanical structure 10 includes three power input terminals 11*a*-11*c*, three power output terminals 12*a*-12*c*, and three trip mechanisms 13*a*-13*c* for opening and closing three pairs of contacts, collectively 14*a*-14*c* (see FIGS. 9 and 10), connected to respective pairs of input and output terminals. Arc suppression chambers 15*a*-15*c* adjacent the three pairs of contacts dissipate and extinguish the arcs that occur when the breaker contacts are opened. Three lugs are positioned over each of the two sets of terminals, such as the lugs 16*a*-16*c* shown in FIGS. 1 and 2 over the output terminals 12*a*-12*c*.

A manually operated toggle 17 permits the breaker contacts to be opened and closed manually, and also permits the trip mechanisms 13*a*-13*c* to be simultaneously reset following a trip. The toggle 17 extends outwardly from an auxiliary housing 18 attached to a main body housing 19, which has been removed in FIG. 2. The mechanisms contained in the basic mechanical structure 10 of the illustrative host circuit breaker are well known and are described in numerous publications, such as U.S. Pat. No. 6,337,449 and U. S. Patent Application Publication No. US 2001/0027961 A1 assigned to the assignee of the present invention.

The basic mechanical structure 10 of the illustrative circuit breaker is capable of being tripped by an electronic trip system (not shown) that includes at least three current sensors that produce signals related to the electrical current flowing between the input and output terminals 12*a*-12*c* when the breaker contacts are closed. These signals from the current sensors are supplied to a control circuit that uses the signals to detect the occurrence of a fault condition, and then produce an electrical trip signal when a fault condition is detected. The trip signal is typically supplied to one or more solenoids having armatures coupled to the trip mechanisms 13*a*-13*c* (FIG. 2) to open a pair of contacts 14 and 14' (see FIGS. 12 and 13) for each of the three phases. Such electronic trip systems are well known and are described in numerous publications, such as U.S. Pat. No. 4,486,803 assigned to the assignee of the present invention.

Figure 3:
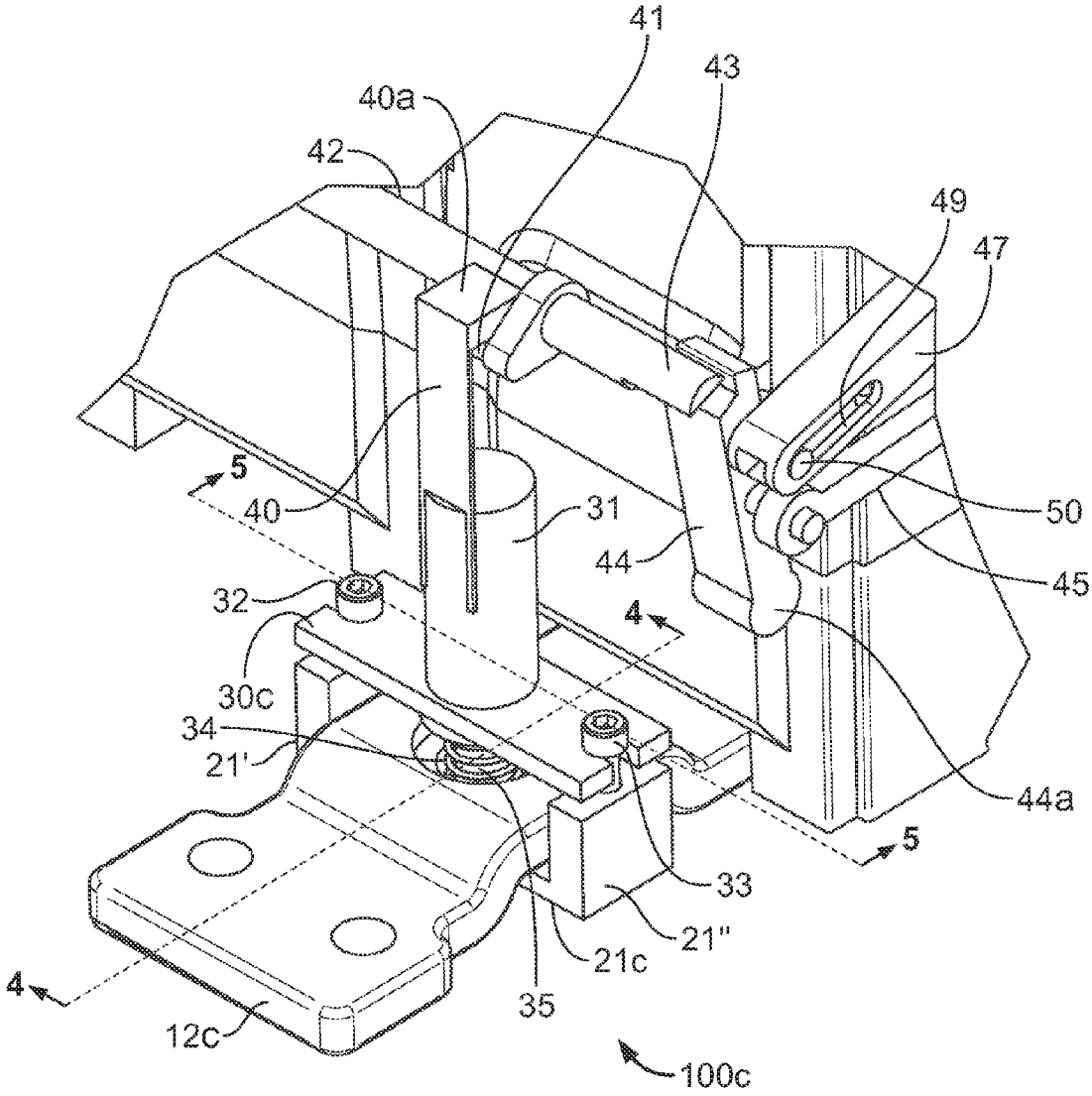
FIG. 3 is an enlarged perspective view of the lower front corner of the structure shown in FIG. 2.
Figure 4:
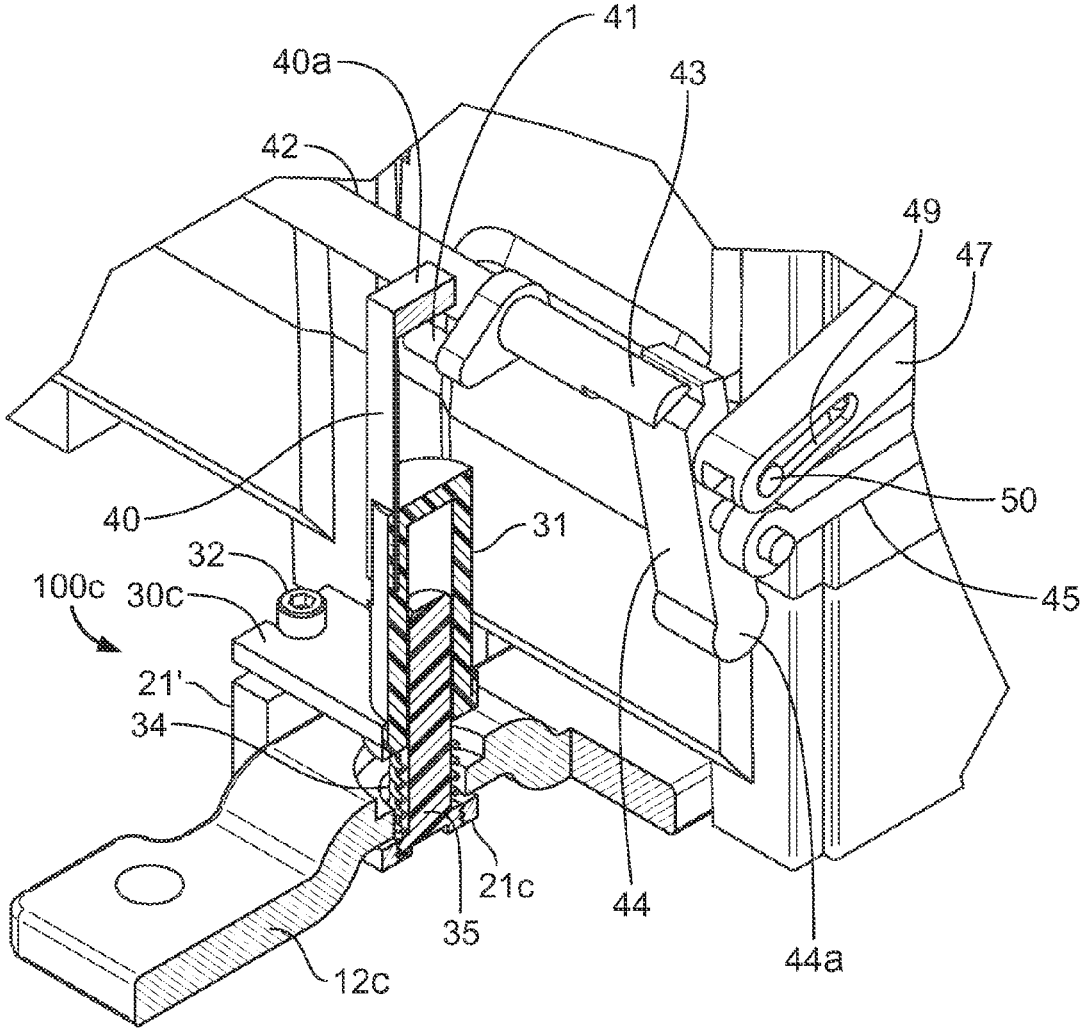
FIG. 4 is a sectional view of the structure shown in FIG. 3 taken along line 4-4 in FIG. 3.

To convert the circuit breaker from electronic actuation to mechanical actuation, an add-on module 20 is attached to one end of the basic mechanical structure 10. The add-on module 20 bridges across the three output terminals 12*a*-12*c*, which are replacements for the input terminals normally used with the basic mechanical structure 10 of the illustrative host circuit breaker. The replacement terminals 12*a*-12*c* have increased lengths to accommodate the insertion of the module 20 between the basic mechanical structure 10 and the lugs 16*a*-16*c* used to attach power cables to the terminals. As can be seen in FIGS. 2-4, the extra length of each of the terminals 12*a*-12*c*, between the end wall of the basic mechanical structure 10 and the corresponding lug 16 (see FIG. 1), is arched to allow the central portion of a stationary ferromagnetic element 21 to pass beneath the terminal. An extension 20*a* (see FIG. 1) of the module 20 extends along one side of the host breaker housing 19 and contains links to the trip and reset mechanisms in the host breaker.

Referring to FIGS. 3-7, the stationary ferromagnetic element 21 is part of an electromechanical transducer 100 that produces mechanical movement in response to a predetermined magnitude of electrical current in the corresponding terminal 12 to which the transducer is coupled. In the illustrated embodiment, the stationary ferromagnetic element 21 is U-shaped with the two legs 21' and 21" of the U extending upwardly past the side edges of the underlying terminal 12. A magnetic flux is induced in the stationary ferromagnetic element 21 when electrical current passes through the corresponding terminal 12, and the strength of the magnetic flux varies as a function of the magnitude of the electrical current. For example, in the event of a short circuit, the current level in the terminal is very high and thus induces a large magnetic flux in the stationary ferromagnetic element 21. Three separate stationary ferromagnetic elements 21*a*-21*c* are coupled to the respective terminals 12*a*-12*c* to form three electromagnetic transducers 100*a*, 100*b* and 100*c*. The magnetic flux increases rapidly to a saturation value as the electrical current in the terminals 12*a*-12*c* increases.

Figure 5:
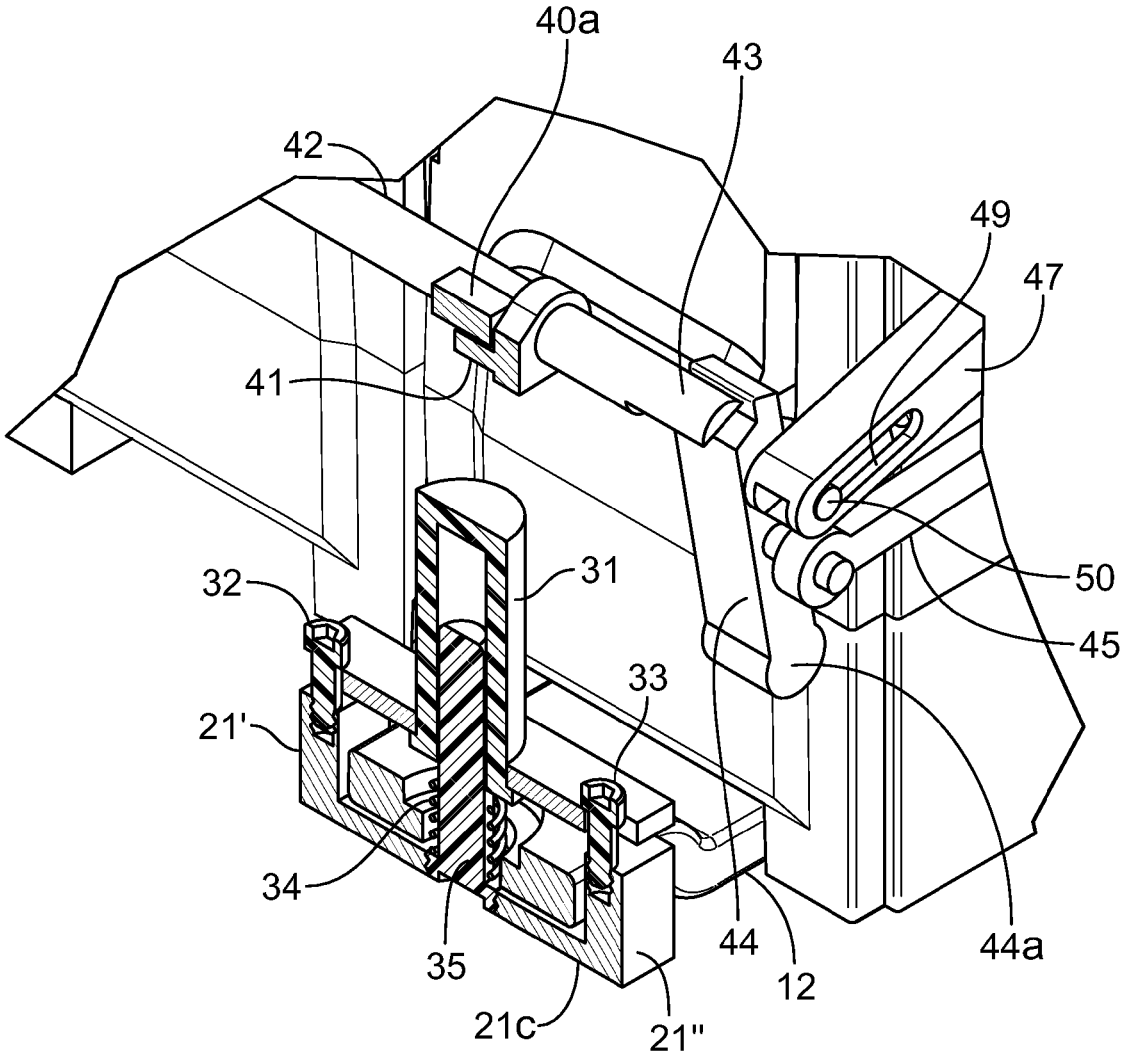
FIG. 5 is a sectional view of the structure shown in FIG. 3 taken along line 5-5 in FIG. 3.
Figure 6:
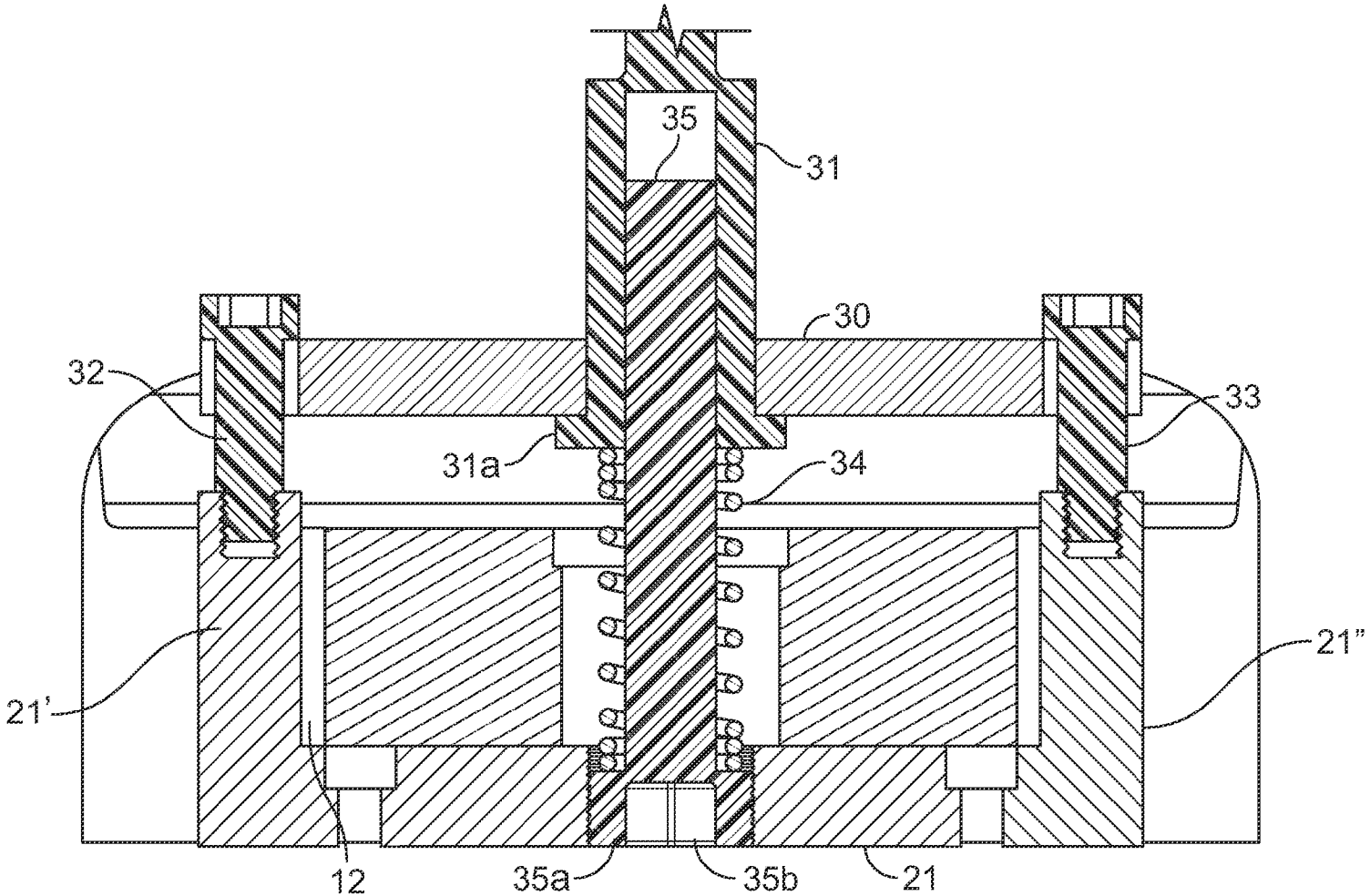
FIG. 6 is a section taken along line 6-6 in FIG. 3.

Directly above the open end of each U-shaped stationary ferromagnetic element 21, a movable rectangular ferromagnetic element 30 extends across the open end of the U and is slidably mounted for vertical movement on a central cylinder 31 and a pair of end posts 32 and 33 attached to the two legs 21' and 21" of the stationary element 21 (see FIG. 5). Three separate movable ferromagnetic elements 30*a*-30*c* are mounted above the respective stationary ferromagnetic elements 21*a*-21*c*. Each of the movable ferromagnetic elements 30*a*-30*c* is biased upwardly by a separate compressed coil spring 34 that is captured between the lower end of the cylinder 31 and the base 35*a* (FIG. 6) of a post 35 that extends upwardly into the cylinder 31. The spring 34 urges the cylinder 31 upwardly so that a flange 31 a on the lower end of the cylinder 31 applies an upward biasing force to the lower surface of the movable ferromagnetic element 30. When the current in the terminal 12 increases to a predetermined threshold, the resulting magnetic flux in the stationary element 21 increases to a level that causes the movable ferromagnetic element 30 to be drawn downwardly against the upward biasing force of the spring 34.

The base 35*a* of the post 35 is threaded into the base of the stationary ferromagnetic element 21 and forms a downwardly opening socket 35*b* that can be used to advance or retract the post 35 to adjust the degree of compression of the spring 34, thereby adjusting the upward biasing force exerted by the spring 34 on the movable ferromagnetic element 30. Increasing the spring force applied to the ferromagnetic element 30 increases the amount of current required to move the ferromagnetic element 30 and trip the breaker. Conversely, decreasing the spring force applied to the ferromagnetic element 30 decreases the amount of current required to move the ferromagnetic element 30 and trip the breaker.

Extending upwardly from the cylinder 31 is a rigid strip 40 that terminates in a flange 40*a* that cantilevers over and engages a pin 41 that is an integral part of a crossbar 42. The pin 41 is biased upwardly against the lower surface of the flange 40*a* by a coil spring (not shown) that biases the crossbar 42 in a clockwise direction (as viewed in FIGS. 3-5). The right-hand end of the crossbar 42 is cut out to form a trip latch 43 that cooperates with a cutout in a hook link 44. As described in detail below, the hook link 44 interacts both with a trip link 45 that is connected to a tripping lever 45*a* coupled to the trip mechanism in the host breaker, and with a cylinder 47 that is connected to the reset mechanism in the host breaker.

Figure 7:
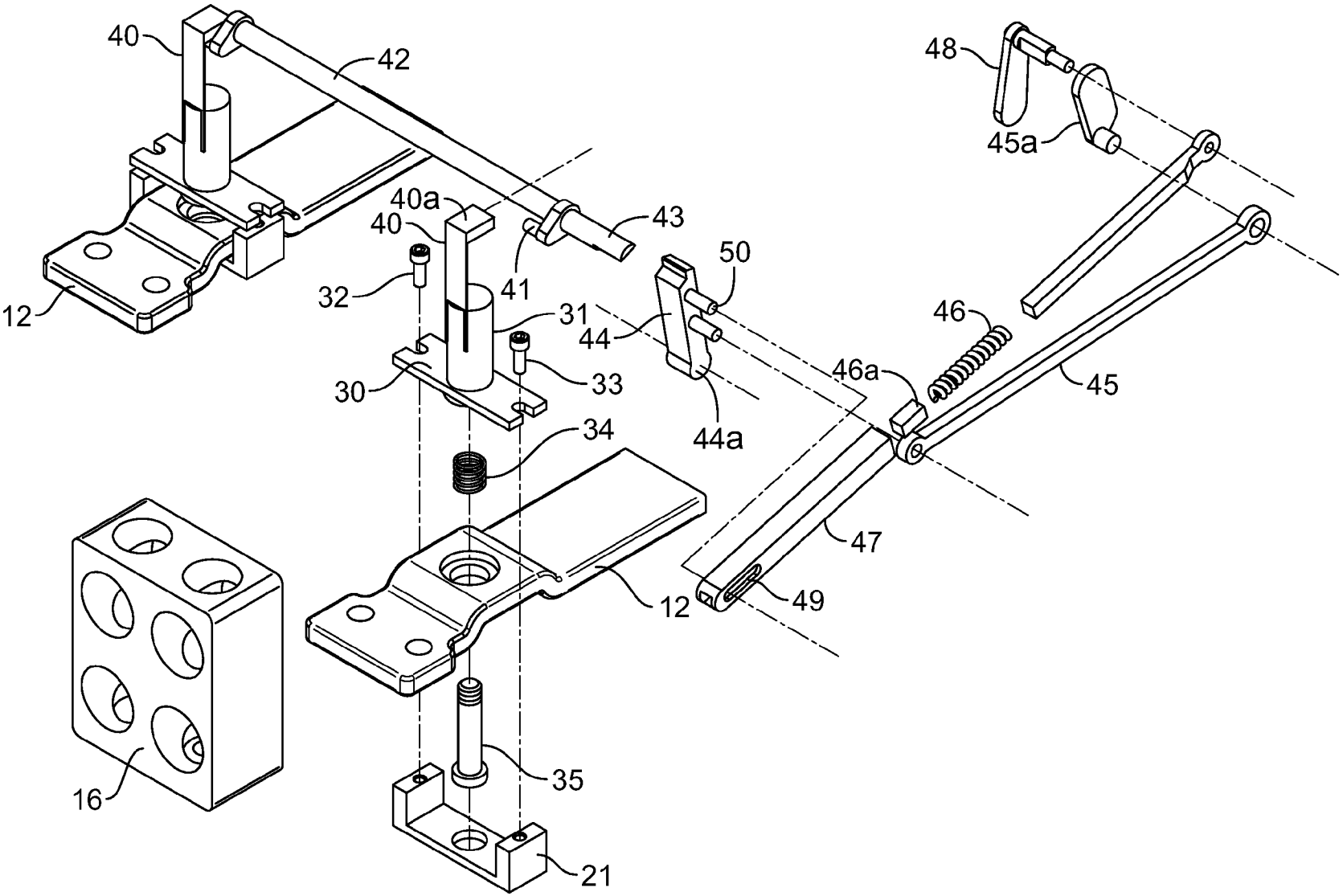
FIG. 7 is an exploded perspective of one of the electromechanical transducers and the mechanical actuator, reset and charging mechanism in the add-on module shown in FIG. 2.

FIGS. 8A-8E and 9A-9E illustrate how the vertical movement of one or more of the movable ferromagnetic elements 30 is utilized to mechanically trip the host circuit breaker (also see FIG. 7).

Figure 8A:
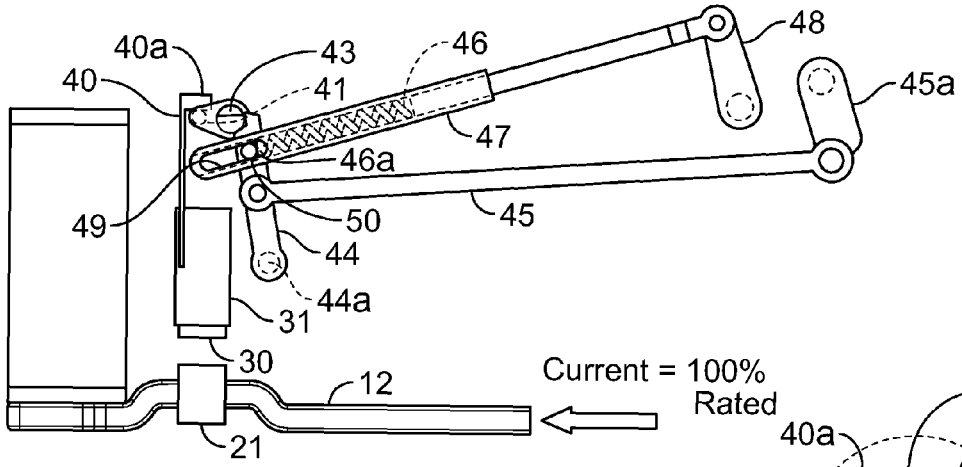
FIGS. 8A through 8E are side elevations of the add-on module of FIG. 2-6 in five different stages of operation.
Figure 9A:
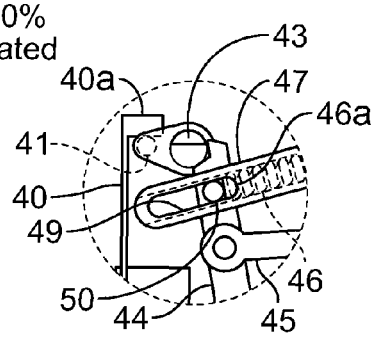
FIGS. 9A through 9E are enlarged side elevations of portions of FIGS. 8A-8E, respectively.
Figure 8B:
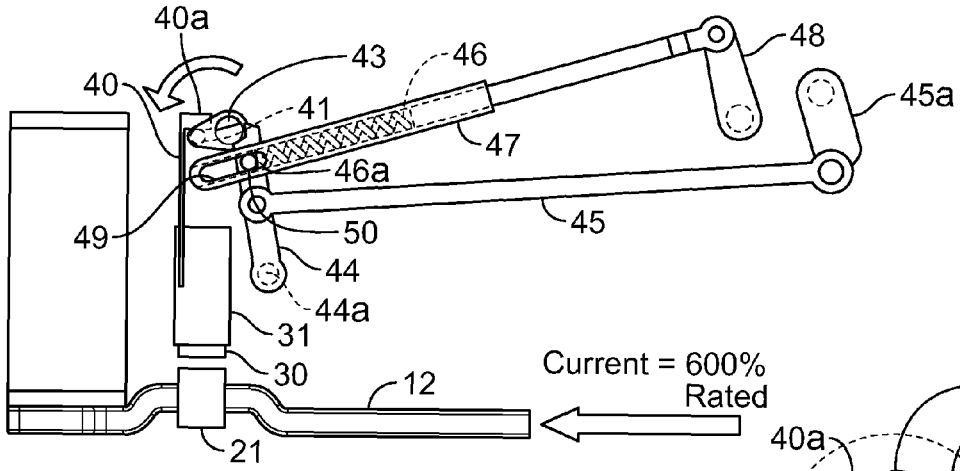

FIG. 8A illustrates the movable ferromagnetic element 30 in its fully raised position, with the trip link 45 of the add-on module latched in its reset, untripped position. FIG. 8B shows the ferromagnetic element 30 in its fully lowered position, with the trip link 45 unlatched but still in its reset, untripped position. As the ferromagnetic element 30 moves downwardly, from the position shown in FIG. 8A to the position shown in FIG. 8B, the cylinder 31 and a link 40 attached to the cylinder 31 also move downwardly. The flange 40*a* on the upper end of the link 40 extends laterally over a pin 41 attached to a crossbar 42. Thus, as element 30 is drawn downwardly, the flange 40*a* draws the pin 41 downwardly, thereby rotating the crossbar 42 slightly (in a counterclockwise direction as viewed in FIG. 8B). This rotational movement of the crossbar 42 turns a trip latch 43 formed by a cutout in the right-hand end of the crossbar 42 (as viewed in FIG. 8B). Before the trip latch 43 is turned, i.e., in the latched position shown in FIG. 8A, the trip latch engages a notched upper end of the hook link 44 pivotally attached to the end of a trip link 45.

Figure 9B:
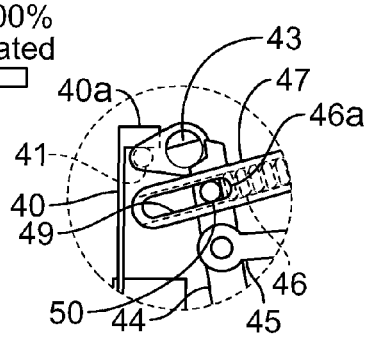
Figure 9C:
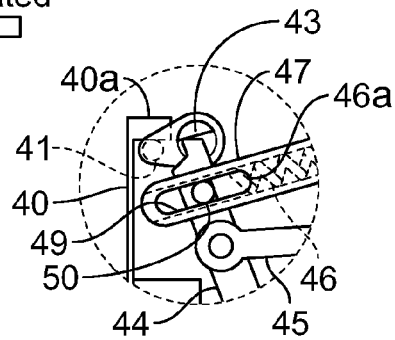

When the crossbar 42 is rotated to the position shown in FIGS. 8B and 9B, the trip latch 43 releases the hook link 44, and an energy storage spring 46 expands inside the cylinder 47 that is coupled to a charging and reset lever 48 in the host breaker. A slot 49 is formed in the left-hand end portion of the cylinder 47 for receiving a pin 50 projecting laterally from the hook link 44. Expansion of the spring 46 advances a small piston 46*a* to push the pin 50 and thus pivot the hook link 44, in counterclockwise direction (as viewed in FIG. 8*c*) around its axis 44*a*, to the position shown in FIGS. 8C and 9C. This pivoting movement of the hook link 44 pulls the trip link 45 to the left (as viewed in FIGS. 8C and 9C), which in turn causes pivoting movement of a tripping lever 45*a* attached to the right-hand end of the trip link 45 in a clockwise direction (as viewed in FIGS. 8C and 9C). Movement of the tripping lever 45*a* in the clockwise direction actuates the trip mechanism in the host breaker to open the breaker contacts.

The tripping lever 45*a* is attached to the same trip mechanism to which the solenoid armature is attached when an electronic actuator is used with the basic mechanical structure 10 of the host breaker. Thus, clockwise movement of the tripping lever 45*a* trips the host circuit breaker in the same manner that movement of the solenoid armature trips the breaker with an electronic actuator.

Figure 8C:
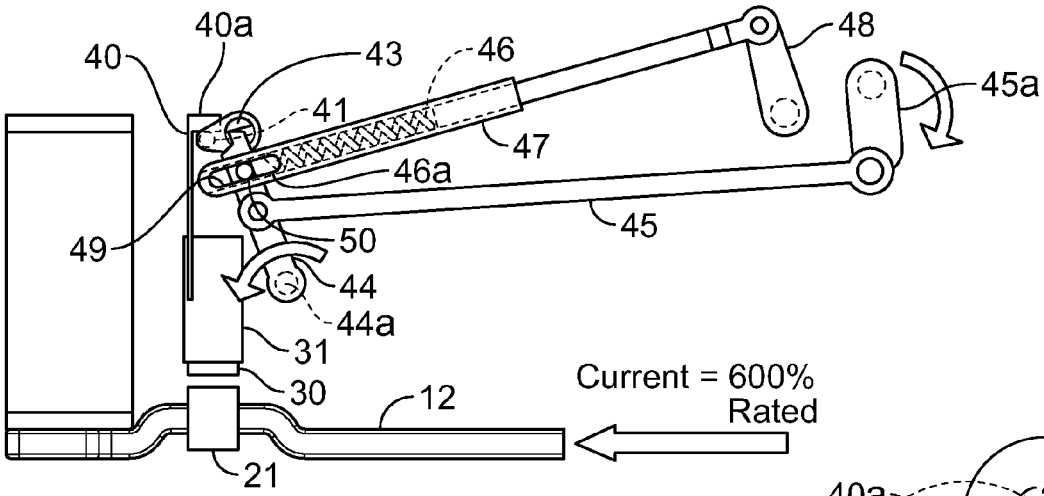
Figure 8D:
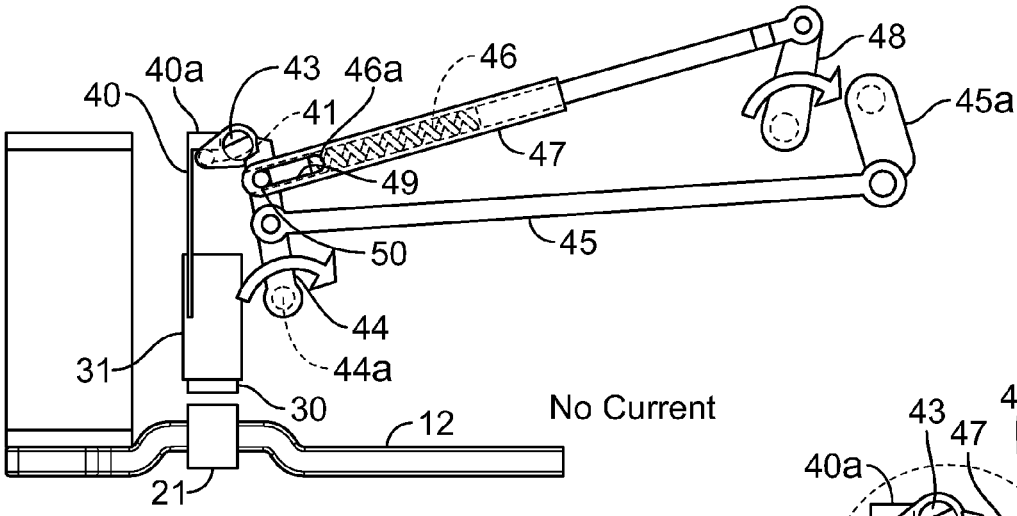
Figure 9D:
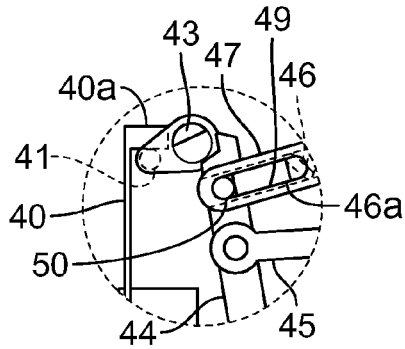

When the host breaker mechanism is reset after being tripped, e.g., by use of the manual toggle 17, a charging and reset lever 48, serving as the mechanical reset arm, is pivoted in a clockwise direction, as indicated by the arrow in FIG. 8D. This movement of the lever 48 pulls the cylinder 47 to the right (as viewed in FIG. 8D), causing the left-hand end of the slot 49 to engage the pin 50 of the hook link 44 and pivot both the hook link 44 and the reset lever 48 in clockwise directions, as indicated by the arrows in FIG. 8D, back to their original positions. This return movement of the hook link 44 also returns both the trip link 45 and the tripping lever 45*a* to their original untripped positions, as illustrated in FIG. 8D.

Figure 8E:
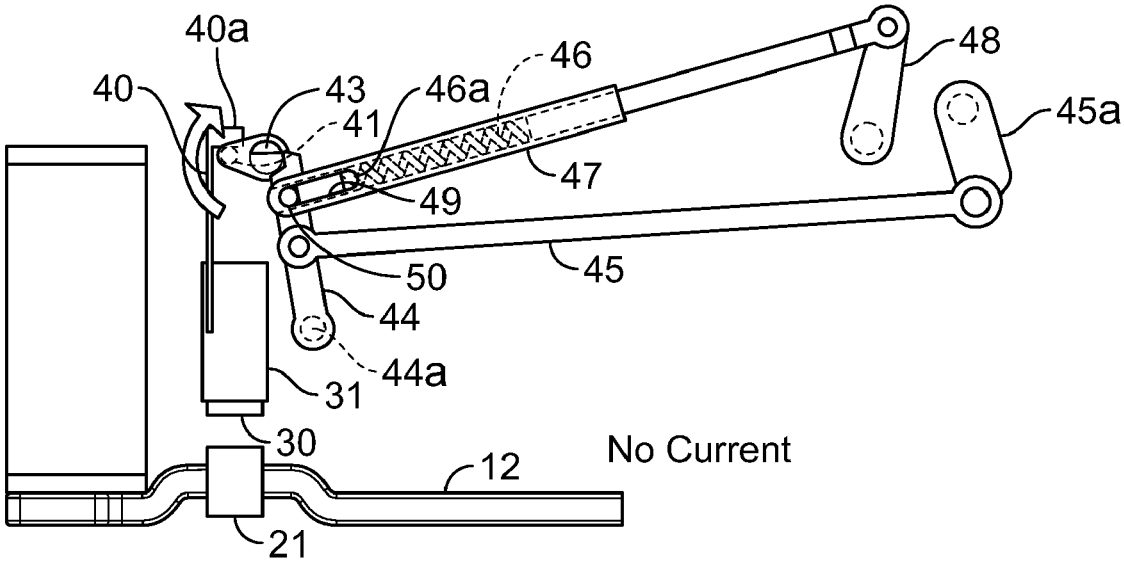
Figure 9E:
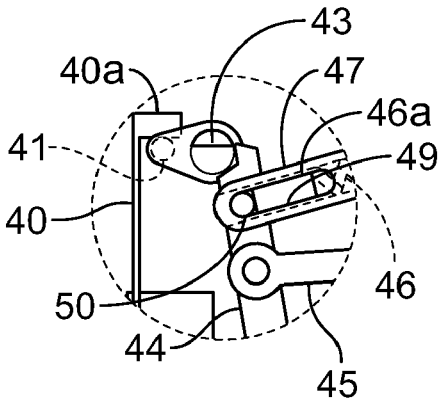

The movement of the hook link 44 allows the crossbar 43 to be rotated in a clockwise direction back to its latched position, shown in FIGS. 8E, 9E, 8A and 8E, by its return spring (not shown). This return movement of the crossbar 43 is not resisted by the flange 40 because the downward force exerted by the movable magnet 30 on the flange 30 is terminated when the host breaker is tripped, interrupting the current flow responsible for that downward force. Then when the lever 48 subsequently returns to its original position shown in FIG. 8A, it moves the cylinder to the left (as viewed in FIGS. 8E, 9E, 8A and 8E), which compresses the spring 46 by advancing the left-hand end of the slot 49 beyond the pin 50 of the latched hook link 44.

The entire actuating mechanism between the movable ferromagnetic elements 30 and the trip mechanism of the host circuit breaker is preferably made of a non-conductive material, such as a polymeric material, to avoid any undesired induced currents or magnetic fluxes. The use of a polymeric material also permits a substantial portion of the actuator to be molded as a single piece, e.g., the crossbar 43 and the links 42, 44 and 45.

Figure 10:
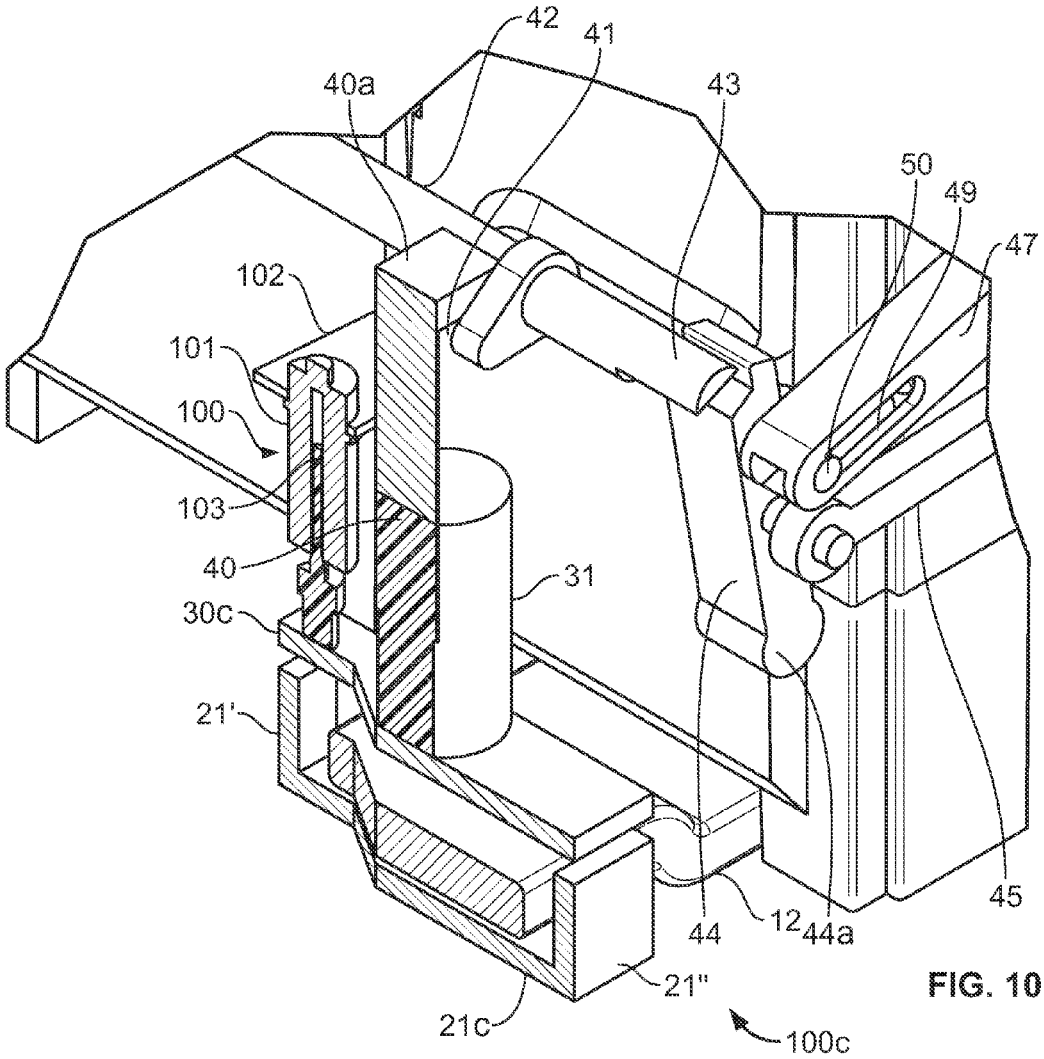
FIG. 10 is a sectional view of a modified embodiment of a mechanical actuating mechanism for use in the add-on module of FIGS. 1-9E.

FIG. 10 illustrates a modified add-on module that includes a dashpot 100 that introduces a delay in the tripping of the circuit breaker by resisting upward movement of the movable ferromagnetic element 30 via viscous friction. The cylinder 101 of the dashpot 100 is mounted on a bracket 102 attached to the circuit breaker housing, so it has a stationary position. The rod 103 of the dashpot is mounted on the movable ferromagnetic element 30 and extends vertically into the cylinder 101 so that the upward movement of the element 30 is damped by hydraulic fluid within the cylinder, thereby reducing the rate at which the element 30 moves upwardly. This delay can avoid an undesired trip of the circuit breaker by a spurious momentary increase in the electrical current in the corresponding terminal 12. Although only one of the electromechanical transducers is shown equipped with a dashpot 100 in FIG. 10, it will be understood that three separate dashpots are coupled to the respective movable ferromagnetic elements 30*a*-30*c*.

Figure 11:
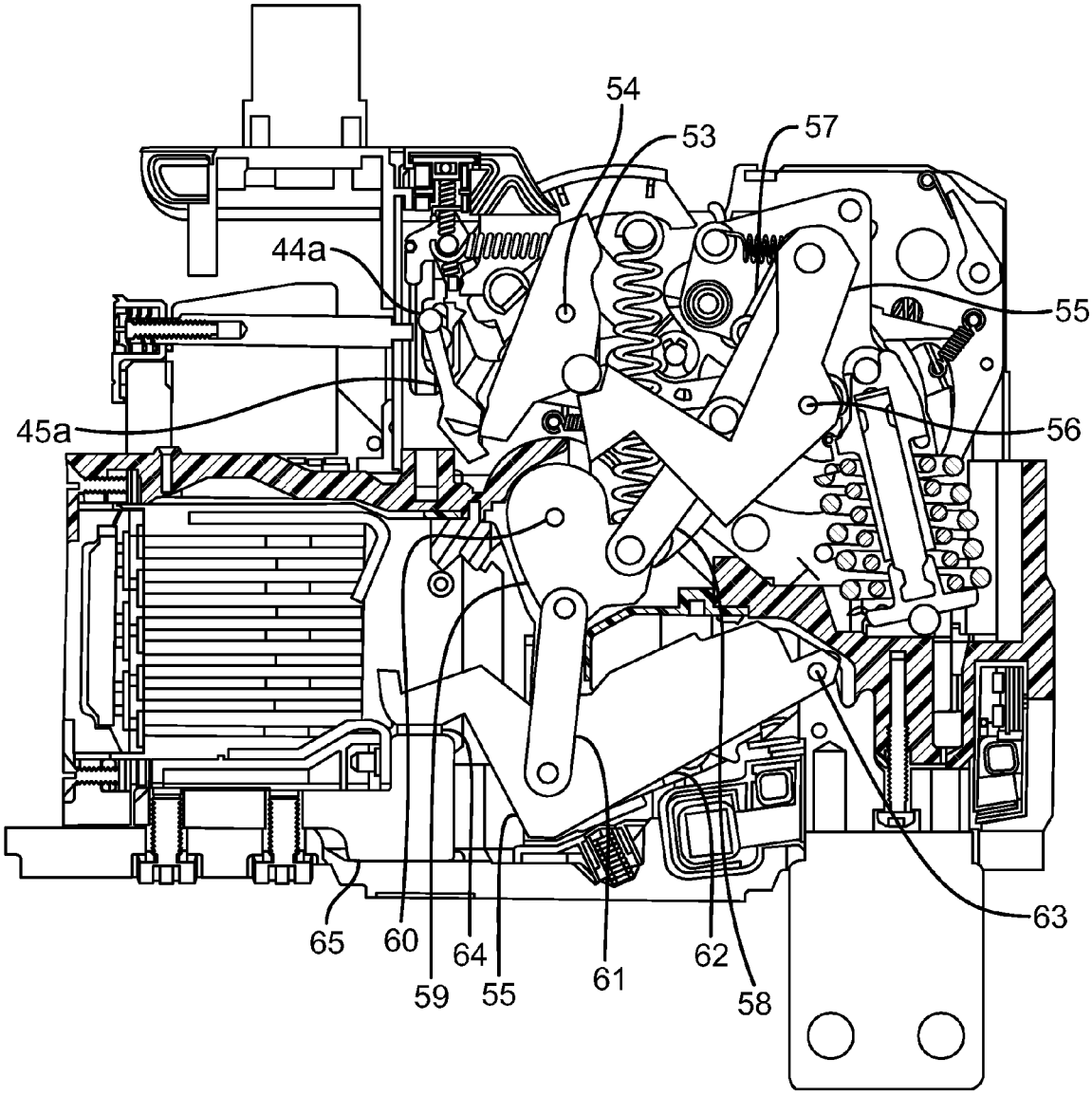
FIG. 11 is a side elevation of the basic mechanical structure of a host multi-pole circuit breaker operated by the actuator of the add-on module shown in FIG. 2.
Figure 12:
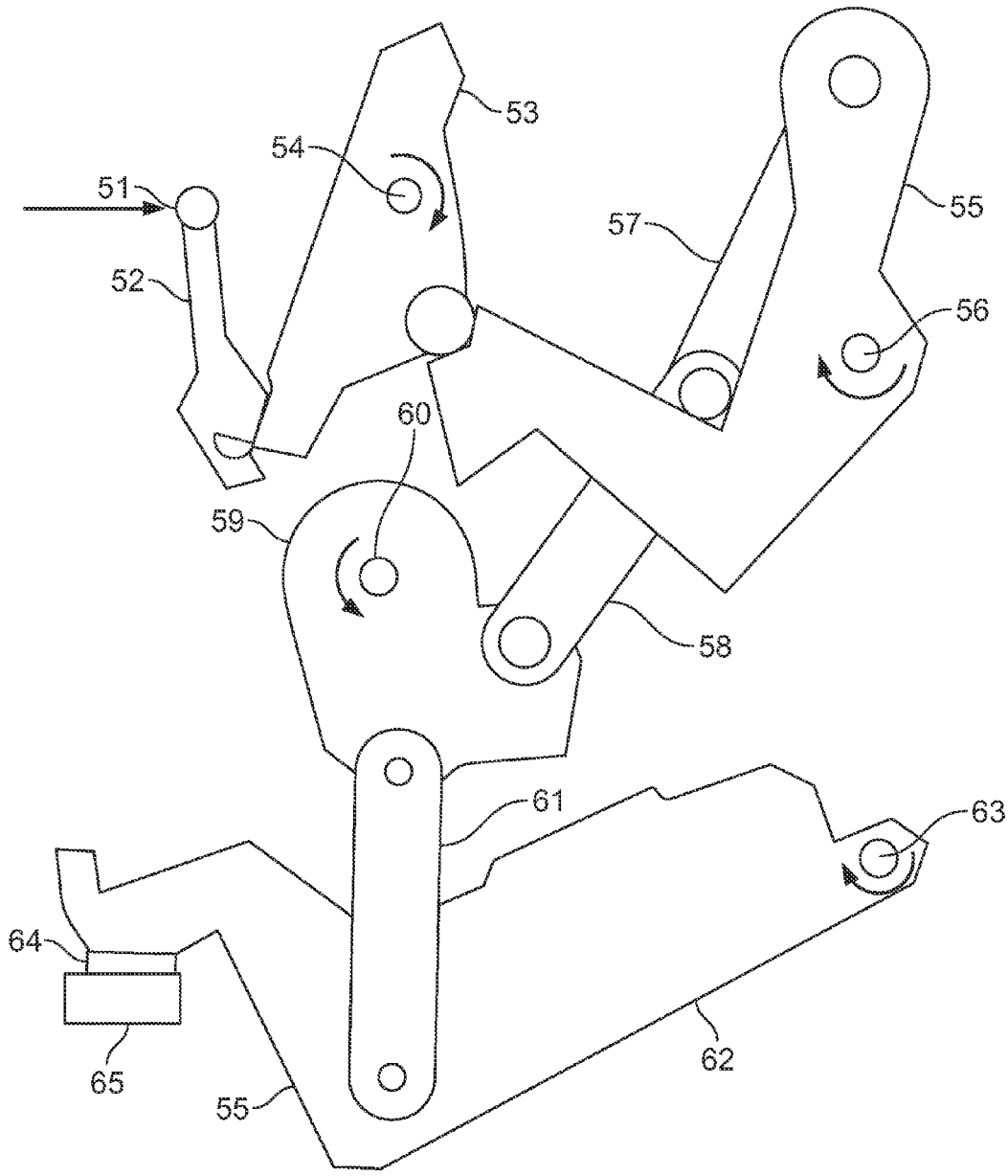
FIGS. 12 and 13 are side elevations of the main components of the basic mechanical structure shown in FIG. 1, in two different stages of operation.
Figure 13:
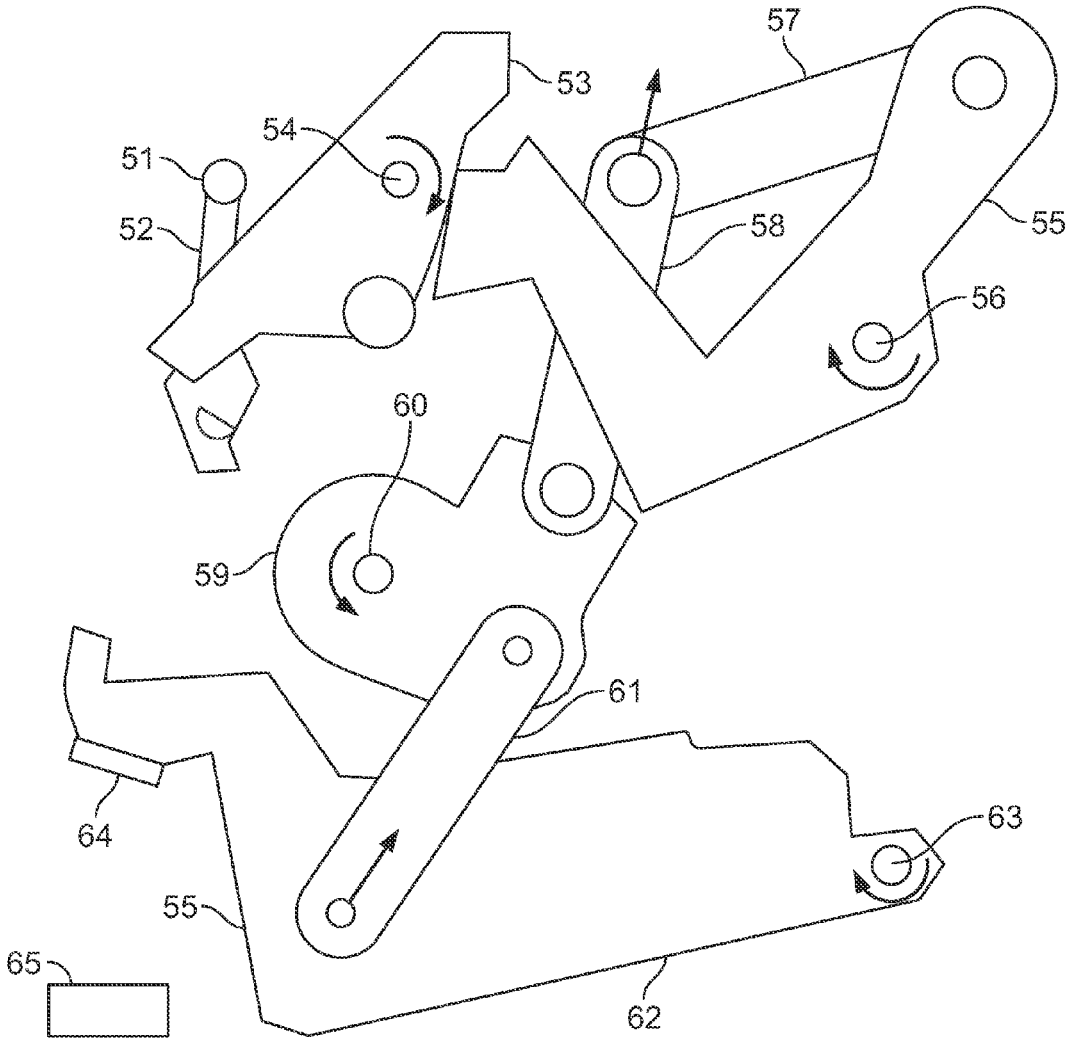

FIGS. 11-13 illustrate the main components of the basic mechanical structure 10 that opens the contacts in the host circuit breaker in response to the mechanical movement of the elongated actuating link 44. FIGS. 11 and 12 illustrate the basic mechanical structure in the ON condition, i.e., with the breaker contacts 64, 65 closed, and FIG. 13 illustrates the same structure in the TRIPPED condition, i.e., with the breaker contacts 64, 65 open. Portions of this basic mechanical structure are described and illustrated in U.S. Pat. No. 6,337,449 assigned to the assignee of the present invention.

The trip lever 45*a* moves laterally projecting pin 51 on the end of a latch bar 52 in the host breaker, thereby pivoting the latch bar 52 to release a latch plate 53 that is spring-biased to pivot in a clockwise direction (as viewed in FIGS. 11-13) around an axis 54. This allows a spring-biased hook plate 55 to pivot in a clockwise direction (as viewed in FIGS. 11-13) around an axis 56. The pivoting movement of the hook plate 55 causes an upper link 57 attached to the upper end of the hook plate 55 to pivot in a clockwise direction (as viewed in FIGS. 11-13) with the hook plate, thereby raising a lower link 58 that connects the lower end of the upper link to a pole bar 59. The upward movement of the lower link 58 turns the pole bar 59 around an axis 60 in a counterclockwise direction (as viewed in FIGS. 11-13), thereby raising a pole link 61. The upward movement of the pole link 61 pivots a pole 62 in a clockwise direction (as viewed in FIGS. 11-13) around an axis 63. The pole 62 carries the movable contact 64, and the pivoting clockwise movement of the pole 62 raises the contact 14*b* to separate it from a mating stationary contact 65. Thus, the mechanical movement of the actuating link 44 is translated into pivoting movement of the movable contact 64 away from the stationary contact 14*b* in each of the three poles, thereby opening the breaker.

The add-on module described above permits the electronic sensing and trip-actuating portions of an electronic multi-pole circuit breaker to be easily replaced with an electromechanical sensing and trip-actuating device suitable for use with AC and DC power systems. The basic mechanical structure of the host circuit breaker used with the electronic actuator is still used with the add-on module, thus taking advantage of the economics of mass production of that basic mechanical structure. The add-on module itself can be manufactured and assembled at a relatively low cost because it has a small number of parts that are easily assembled.

Figure 14:
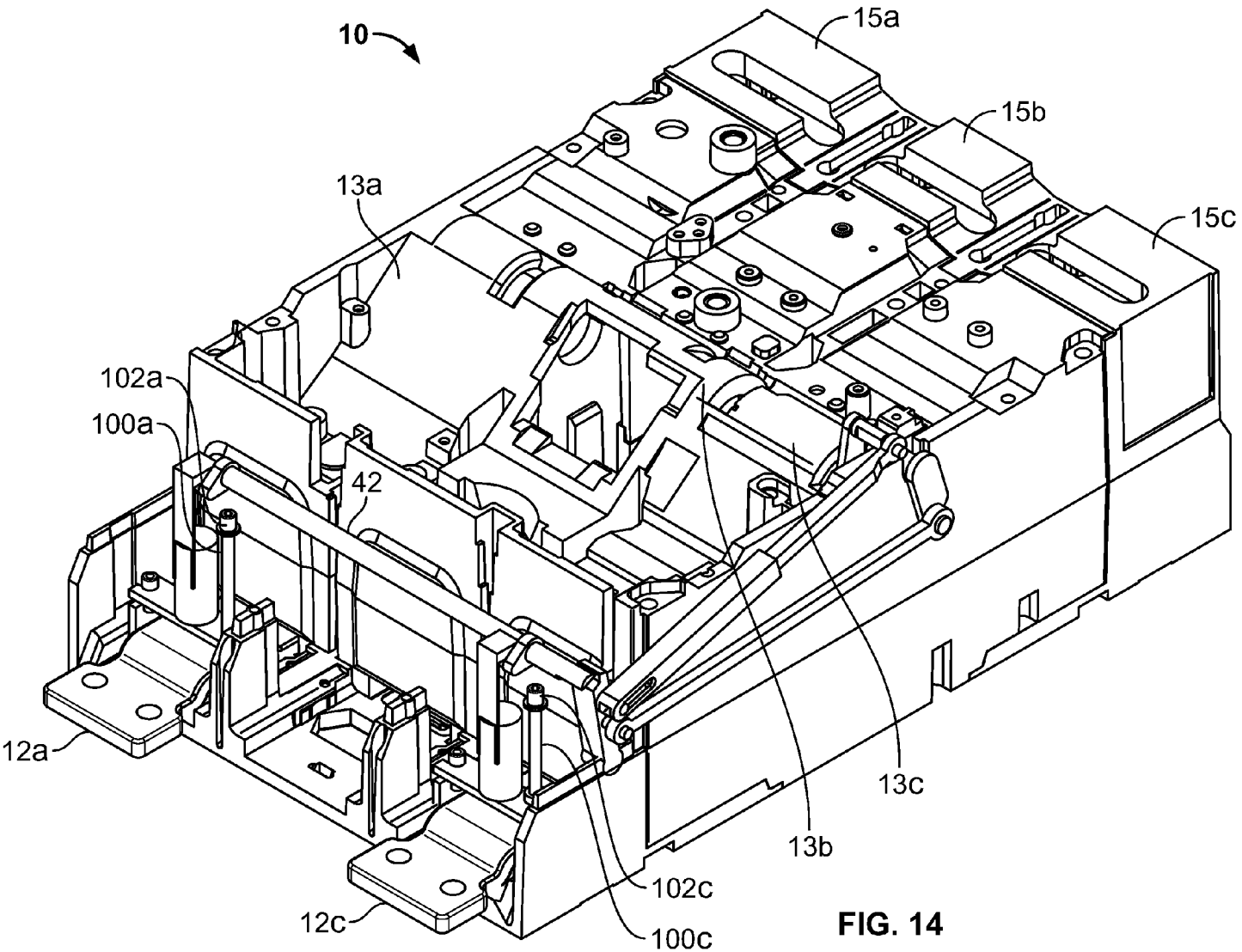
FIG. 14 is a perspective view of a modified add-on module that includes an externally accessible adjustment for adjusting the size of the air gap between stationary and movable ferromagnetic elements.
Figure 15:
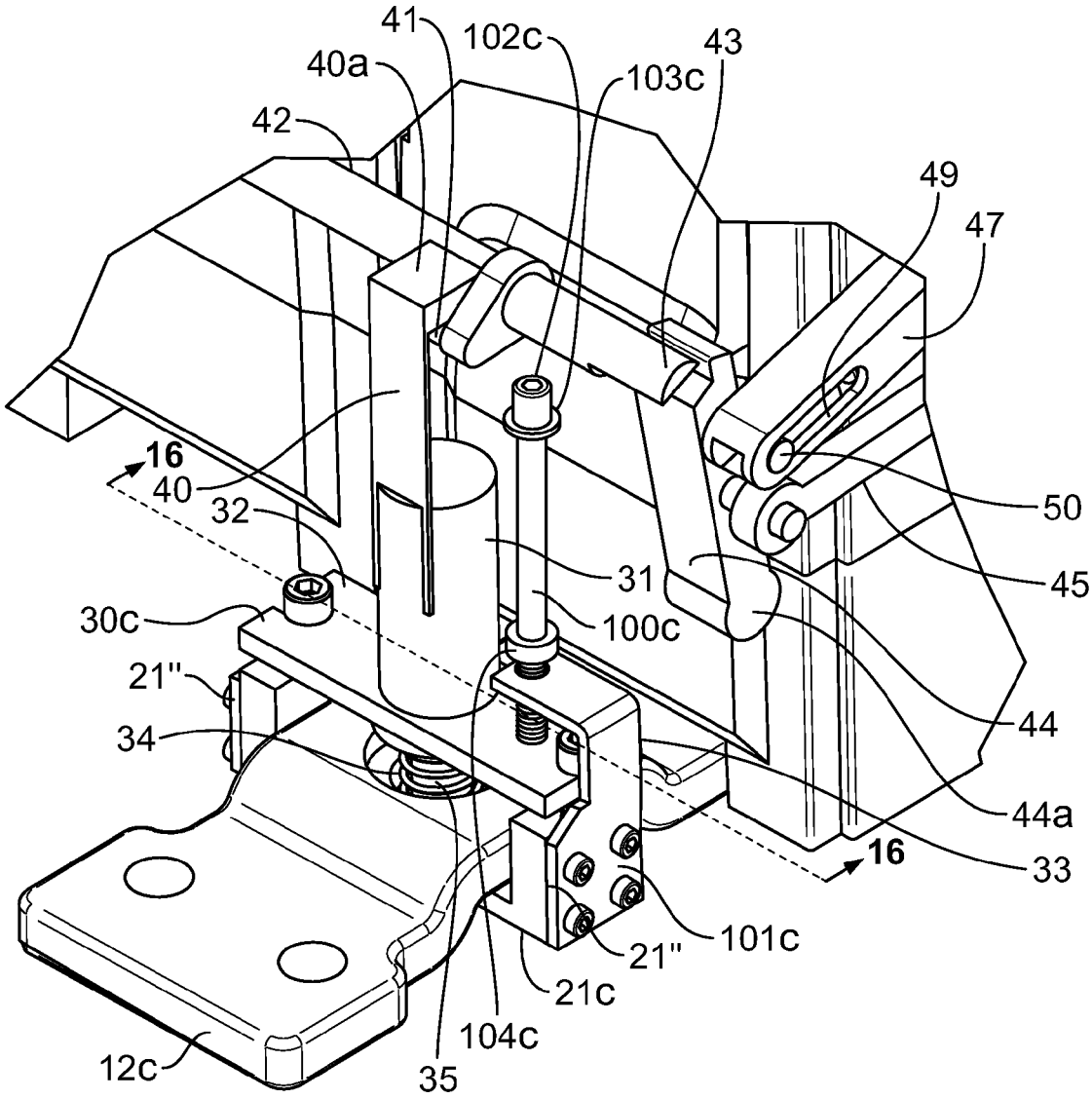
FIG. 15 is an enlarged perspective view of the right-hand end of the add-on module shown in FIG. 14.
Figure 16:
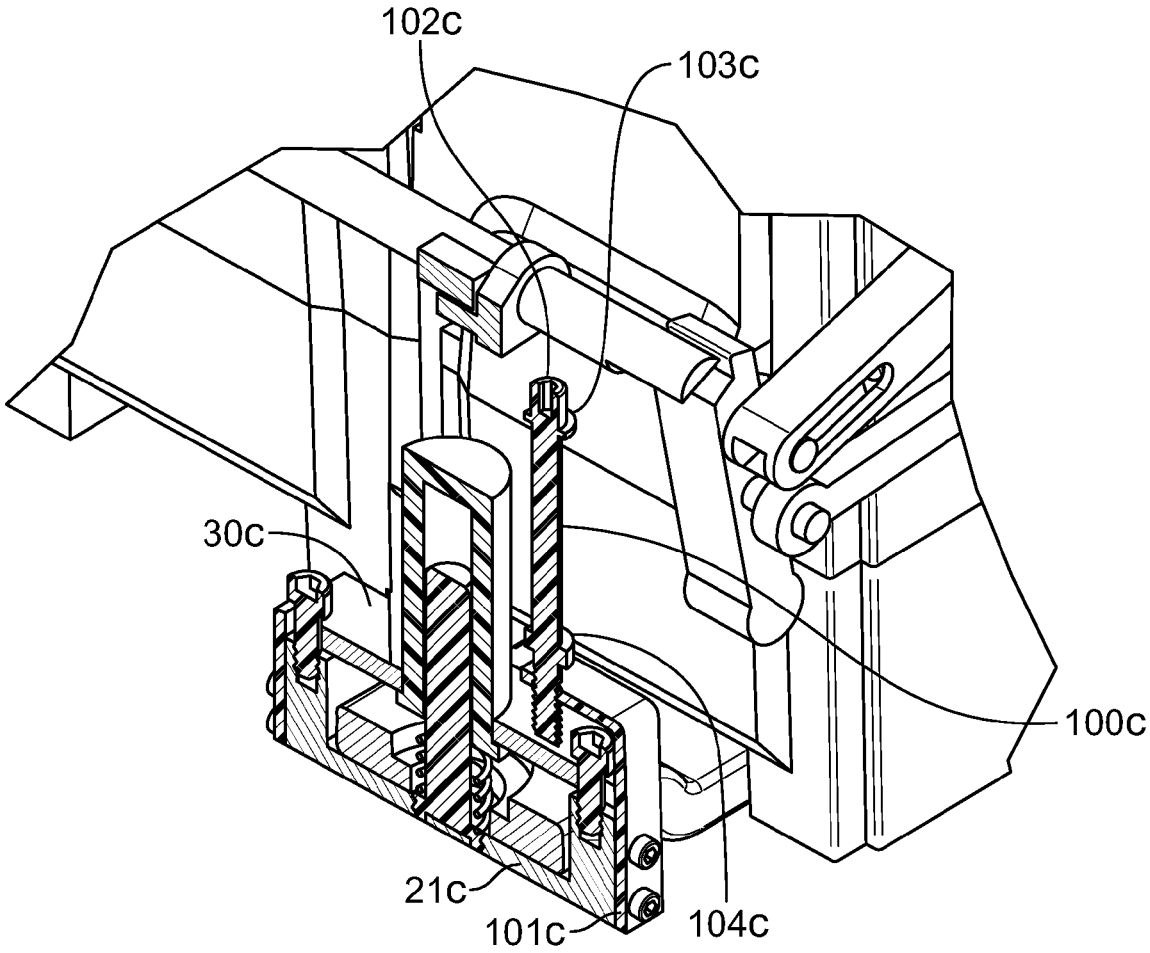
FIG. 16 is an enlarged sectional view taken along line 16-16 in FIG. 15.

FIGS. 14-16 illustrate a modified add-on module that includes externally accessible adjustment screws 100*a*-100*c* for adjusting the size of the air gap between the respective stationary ferromagnetic elements 21*a*-21*c* and the corresponding movable ferromagnetic elements 30*a*-30*c*. The screws 100*a*-100*c* are threaded through and supported by respective stationary brackets 101*a*-101*c*. The lower ends of the screws 100*a*-100*c* engage the upper surfaces of the respective movable ferromagnetic elements 30*a*-30*c* so that the uppermost positions of the movable ferromagnetic elements 30*a*-30*c* can be adjusted by turning the screws 100*a*-100*c* to raise or lower the vertical positions of the lower ends of the screws. Changing the uppermost positions of the movable ferromagnetic elements 30*a*-30*c* changes the maximum air gaps between the respective stationary ferromagnetic elements 21*a*-21*c* and the corresponding movable ferromagnetic elements 30*a*-30*c*, which in turn alters the time required to trip the breaker in response to a predetermined increase in the current level.

The shanks of the screws 100*a*-100*c* are vertically elongated so that the screw heads 102*a*-102*c* extend upwardly into mating apertures (not shown) in the housing of the add-on module 20 so that sockets in the upper ends of the screw heads 102*a*-102*c* are accessible through the respective apertures. The user can use a driver that mates with the sockets to turn the screws 100*a*-100*c* without removing the housing of the module 20. Flanges 103*a*-103*c* at the bases of the respective screw heads 102*a*-102*c* overlap the lower surface of the upper wall of the housing of the module 20 to limit the upward movement of the respective screws 100*a*-100*c* to prevent inadvertent removal of the screws from the brackets 100*a*-100*c*. Flanges 104*a*-104*c* at the lower ends of the shanks of the screws 100*a*-100*c* limit the downward movement of the respective screws, thereby limiting the minimum size of the respective air gaps.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

The invention claimed is:

1. In a multiple-pole circuit breaker comprising a host circuit breaker having a basic mechanical structure that includes, for each pole a power input terminal and a power output terminal, a pair of contacts each of which is connected to a different one of said terminals and at least one of which is movable, a trip mechanism coupled to said movable contact for opening said contacts by disengaging said movable contact from the other contact in said pair, an electronic trip system that includes a plurality of current sensors producing signals related to the electrical current flow between said power input and output terminals, and a control circuit receiving said signals, detecting the occurrence of a fault condition, and producing an electrical trip signal when a fault condition is detected, a solenoid receiving said trip signal and coupled to said trip mechanism for moving said trip mechanism to open said contacts in response to said trip signal, and a reset mechanism coupled to said trip mechanism for resetting said trip mechanism and said movable contact, the improvement comprising an add-on module adapted to be attached to said basic mechanical structure and including multiple extended terminals each of which is adapted to replace one of said terminals for one of said poles, multiple electromechanical transducers each of which is coupled to one of said extended terminals for producing a mechanical movement in response to a predetermined magnitude of electrical current in the extended terminal to which that transducer is coupled, a mechanical trip link coupled to said electromechanical transducers and to said movable contacts for operating said trip mechanism in response to a predetermined movement of any of said transducers, and a mechanical reset arm coupling said reset mechanism to said mechanical actuator for resetting said actuator in response to the resetting of said host circuit breaker.

2. The multiple-pole circuit breaker of claim 1 in which said trip link is coupled to said trip mechanism for actuating said trip mechanism to open said contacts, and further comprising a latch having a latched condition holding said trip link in an untripped position, and an unlatched condition releasing said trip link for movement to a tripped position, and a latch release mechanism for moving said latch to said unlatched condition in response to said predetermined movement of any of said transducers.

3. The multiple-pole circuit breaker of claim 2 which includes an energy storage device coupled to said latch and said trip link for moving said trip link to said tripped position in response to the movement of said latch to said unlatched position.

4. The multiple-pole circuit breaker of claim 3 in which said mechanical reset arm is coupled to said energy storage device for re-charging said energy storage device in response to the resetting of said trip mechanism of said host circuit breaker.

5. The multiple-pole circuit breaker of claim 1 in which each of said electromechanical transducers includes an element that moves in response to a predetermined magnitude of electrical current in the extended terminal to which that transducer is coupled, and a dashpot coupled to said movable element for controlling the rate of movement of said element.

6. The multiple-pole circuit breaker of claim 5 in which said movable element is a ferromagnetic element that is electromagnetically coupled to said extended terminal to which that transducer is coupled.

7. The multiple-pole circuit breaker of claim 1 in which each of said electromechanical transducers includes a ferromagnetic element adjacent one of said terminals for generating a magnetic flux having a strength related to the magnitude of electrical current passing through said adjacent terminal.

8. The multiple-pole circuit breaker of claim 1 in which each of said electromechanical transducers comprises a stationary U-shaped ferromagnetic element positioned directly adjacent one of said extended terminal, and a movable ferromagnetic element mounted adjacent the open end of said U-shaped element and mounted for movement in response to said magnetic flux generated by a predetermined magnitude of electrical current in the extended terminal to which that transducer is coupled.

9. The multiple-pole circuit breaker of claim 1 which includes a biasing spring resisting said mechanical movement until said electrical current in said extended terminal to which that transducer is coupled is increased to a predetermined level, and an adjustment device coupled to said biasing spring for adjusting the resisting force of said biasing spring and thereby adjusting said predetermined magnitude of electrical current at which said mechanical movement is produced.

10. An add-on module for activating a trip mechanism of a circuit breaker for a multi-phase electrical power distribution system, said circuit breaker having multiple terminals each of which is adapted to be electrically connected to one of the multiple phase lines, a pair of fixed and movable contacts for each of the multiple, a trip mechanism for moving said movable contacts to open and close the phase lines, an electronic trip system that includes a plurality of current sensors producing signals related to the electrical current flow in said phase lines, a control circuit receiving said signals, detecting the occurrence of a fault condition, and producing an electrical trip signal when a fault condition is detected, and a solenoid receiving said trip signal and coupled to said trip mechanism for moving said trip mechanism to open said contacts in response to said trip signal, said module comprising:

multiple extended terminals each of which is adapted to replace one of said terminals for one of said poles, multiple electromechanical transducers each of which is coupled to one of said extended terminals for producing a mechanical movement in response to a predetermined magnitude of electrical current in the extended terminal to which that transducer is coupled, a mechanical trip link coupled to said electromechanical transducers and to said movable contacts for operating said trip mechanism in response to a predetermined movement of any of said transducers, and a mechanical reset arm coupling said reset mechanism to said mechanical trip link for resetting said trip link in response to the resetting of said host circuit breaker.

11. The multiple-pole circuit breaker of claim 10 in which said mechanical trip link is coupled to said trip mechanism for actuating said trip mechanism to open said contacts, and further comprising a latch having a latched condition holding said trip link in an untripped position, and an unlatched condition releasing said trip link for movement to a tripped position, and a latch release mechanism for moving said latch to said unlatched condition in response to said predetermined movement of any of said transducers.

12. The multiple-pole circuit breaker of claim 11 which includes an energy storage device coupled to said latch and said trip link for moving said trip link to said tripped position in response to the movement of said latch to said unlatched position.

13. The multiple-pole circuit breaker of claim 12 in which said mechanical reset arm is coupled to said energy storage device for re-charging said energy storage device in response to the resetting of said trip mechanism of said host circuit breaker.

14. The multiple-pole circuit breaker of claim 10 in which each of said electromechanical transducers includes an element that moves in response to a predetermined magnitude of electrical current in the extended terminal to which that transducer is coupled, and a dashpot coupled to said movable element for controlling the rate of movement of said element.

15. The multiple-pole circuit breaker of claim 14 in which said movable element is a ferromagnetic element that is electromagnetically coupled to said extended terminal to which that transducer is coupled.

16. The multiple-pole circuit breaker of claim 10 in which each of said electromechanical transducers includes a ferromagnetic element adjacent one of said terminals for generating a magnetic flux having a strength related to the magnitude of electrical current passing through said adjacent terminal.

17. The multiple-pole circuit breaker of claim 10 in which each of said electromechanical transducers comprises a stationary U-shaped ferromagnetic element positioned directly adjacent one of said extended terminals, and a movable ferromagnetic element mounted adjacent the open end of said U-shaped element and mounted for movement in response to said magnetic flux generated by a predetermined magnitude of electrical current in the extended terminal to which that transducer is coupled.

18. The multiple-pole circuit breaker of claim 10 which includes a biasing spring resisting said mechanical movement until said electrical current in said extended terminal to which that transducer is coupled is increased to a predetermined level, and an adjustment device coupled to said biasing spring for adjusting the resisting force of said biasing spring and thereby adjusting said predetermined magnitude of electrical current at which said mechanical movement is produced.

19. The multiple-pole circuit breaker of claim 1 which includes an adjustment screw for adjusting the position of each of said movable ferromagnetic elements so as to change the size of an air gap between said movable ferromagnetic element and the corresponding stationary ferromagnetic element.

* * * * *